US006679490B2

(12) United States Patent
Pioquinto et al.

(10) Patent No.: US 6,679,490 B2
(45) Date of Patent: Jan. 20, 2004

(54) PIC ROLLER WITH CLUTCH

(75) Inventors: Jose Pioquinto, Mundelein, IL (US); James Russo, Chgo. Hts., IL (US)

(73) Assignee: Bowe Bell + Howell Scanners, L.L.C., Lincolnwood, IL (US)

( * ) Notice: Subject to any disclaimer, the term of this patent is extended or adjusted under 35 U.S.C. 154(b) by 0 days.

(21) Appl. No.: 10/057,743

(22) Filed: Jan. 25, 2002

(65) Prior Publication Data

US 2003/0173731 A1 Sep. 18, 2003

(51) Int. Cl.[7] ..... B65H 3/06

(52) U.S. Cl. ..... 271/116; 271/114; 271/10.13; 271/10.03

(58) Field of Search ..... 271/10.02, 10.03, 271/10.13, 114, 116

(56) References Cited

U.S. PATENT DOCUMENTS 6,059,279 A * 5/2000 Wenthe, Jr. ..... 271/10.13

6,182,961 B1 * 2/2001 Wenth, Jr. ..... 271/114

* cited by examiner

*Primary Examiner*—Donald P. Walsh
*Assistant Examiner*—Kaitlin Joerger
(74) *Attorney, Agent, or Firm*—McDermott, Will & Emery

(57) ABSTRACT

A feeder roller apparatus for high speed image scanning equipment, which improves feeding of documents, and in particular short documents, sequentially fed from a stack. The feeder apparatus comprises a PIC roller and an infeed roller which are selectively, independently driven via a dual drive shaft, composed of an inner drive shaft and an outer drive shaft, driven together or selectively, independently by a main motor. An electro-mechanical clutch, when energized is used to drive the PIC roller. A sensor is provided downstream of the rollers to recognize when a document is being fed. Initially, the clutch is energized, and both rollers are driven. When the first sheet reaches the sensor, the clutch is de-energized, cutting off the drive to the PIC roller. The main motor continues driving only the infeed roller until the first sheet is fed.

13 Claims, 2 Drawing Sheets

PIC ROLLER WITH CLUTCH

The present invention relates to a document feeder for an imaging device such as a scanner, facsimile, or the like, and in particular, to an apparatus for the improved feeding of documents, especially short documents, to high speed image scanning equipment. Specifically, the present invention relates to a feed roller apparatus having a picking (PIC) roller and an infeed roller which are selectively, independently driven responsive to a sensor.

BACKGROUND OF THE INVENTION

It is well known in the art of imaging/printing equipment to use a document feeder to support a stack of documents, and feed these documents to the imaging/printing equipment, one at a time from the stack. With respect to imaging equipment, a picking (PIC) roller of a skimmer apparatus typically propels the first sheet to an infeed roller, which then feeds the sheet to the imaging equipment.

However, special problems arise when it is attempted to feed sheets of a limited length, i.e., short sheets, to the imaging equipment. Known feeders have not been able to adequately feed such short sheets to the imaging equipment.

In prior art devices, the PIC roller and the infeed roller are driven together. In the case of short sheets, the first sheet typically clears the PIC roller too soon (i.e., before enough of the first sheet is fed by the infeed roller); thus exposing the PIC roller to the second sheet too soon. As a result, since the PIC roller is still rotating, the second sheet will be driven forward too soon, resulting in buckling of the second sheet. This can lead to paper jams, improper feeding, and/or the damage to the sheets such as by folding or creasing, etc.

While there are numerous prior art apparatus for feeding documents, there are no known apparatus that can adequately feed short sheets to imaging equipment. Such prior art devices cannot achieve the advantages and improvements achieved by the present invention.

Accordingly, there is a need for an apparatus for feeding short documents to select equipment, one at a time, in a smooth, efficient and continuous manner, without misfeeding or damaging the documents or creating paper jams. The present invention fulfills such a need.

BRIEF SUMMARY OF THE INVENTION

The present invention relates to a feeder roller apparatus for high speed image scanning equipment, which improves feeding of documents, and in particular, short documents. Documents or sheets are sequentially fed from a stack via a PIC roller and an infeed roller. The invention comprises a feeder roller apparatus which selectively, independently drives the PIC roller and the infeed roller.

The PIC roller and the infeed roller of the present invention are driven via a dual drive shaft, composed of an inner drive shaft and an outer drive shaft, which are driven either together or selectively, independently by a main motor. An electro-mechanical clutch, when energized is used to drive the PIC roller. A sensor is provided downstream of the rollers to recognize when a document is being fed. Initially, the clutch is energized, and both rollers are driven. When the first sheet reaches the sensor, the clutch is de-energized, cutting off the drive to the PIC roller. The main motor continues driving only the infeed roller until the first sheet is fed out of the feeder and into the transport of the scanning equipment.

Accordingly, it is the principal object of the present invention to provide an apparatus for feeding documents to imaging/printing equipment.

It is also an object of the invention to provide a feeder apparatus for feeding short documents to high speed image scanning equipment.

It is an additional object of the present invention to provide a feeder having a PIC roller and an infeed roller which are selectively, independently driven.

It is another object of the present invention to provide a dual shaft drive system having a clutch for selectively disengaging a PIC roller in response to a sensor sensing a document being fed by an infeed roller.

It is a further object of the present invention to provide a method and apparatus for feeding a stack of documents, and especially short documents, one at a time from the stack to any desired equipment in a controlled, precise manner to avoid paper jams, misfeeding or damage to the documents.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
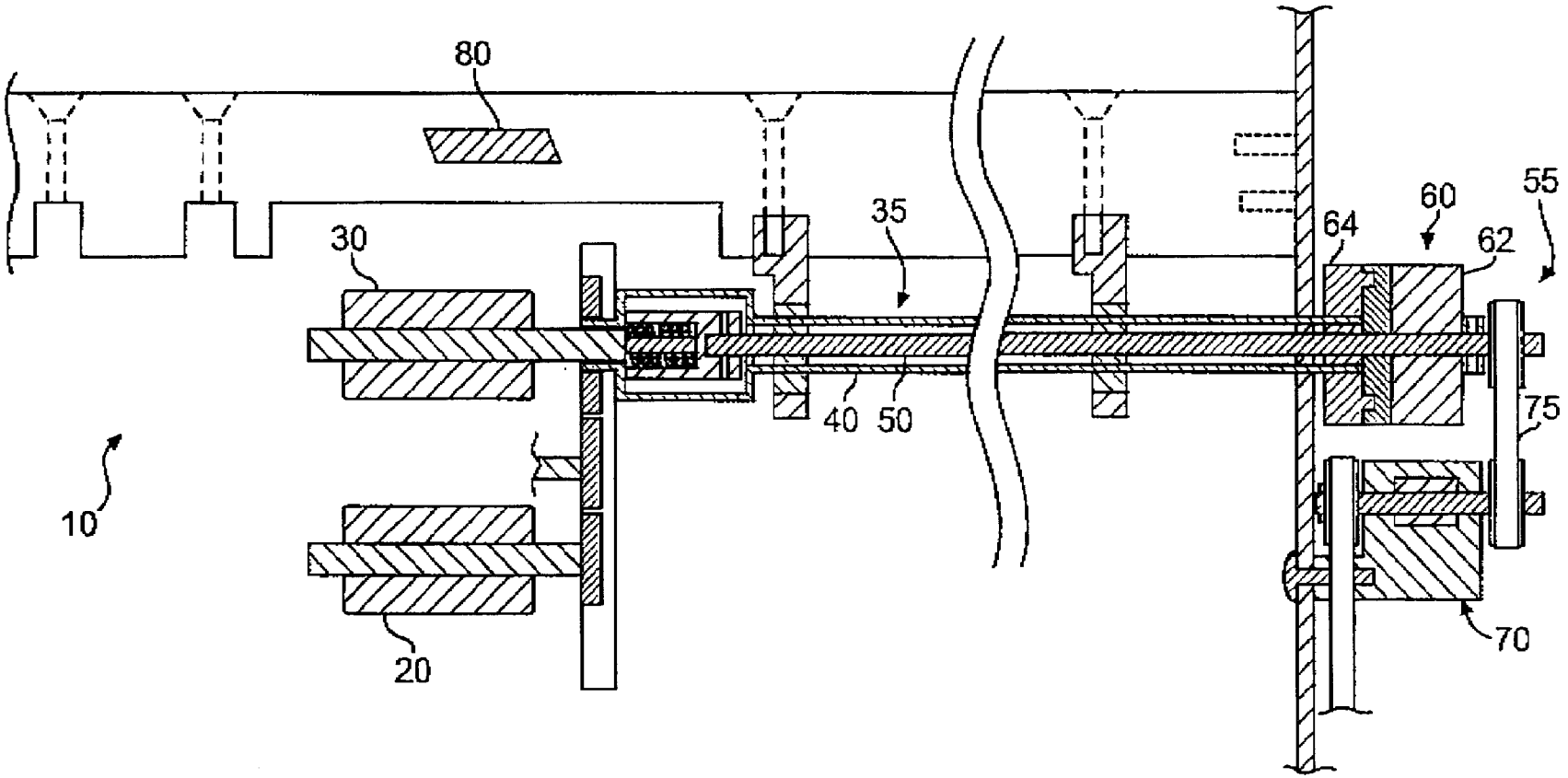
FIG. 1 is a schematic cross-sectional view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

FIG. 1 illustrates the present invention or feeder apparatus 10 for feeding documents or sheets of paper or the like to any type of equipment as is known in the art, such as imaging equipment, e.g., a scanner. Feeder apparatus 10 includes a picking roller or PIC roller 20 of a skimmer apparatus which propels the first sheet of a stack of sheets to an infeed roller 30. The infeed roller 30 in turn feeds the sheet into the imaging equipment.

The present invention 10 further includes a dual drive shaft 35 which selectively drives both the PIC roller 20 and the infeed roller 30. Dual drive shaft 35 comprises an outer drive shaft 40 and a concentric inner drive shaft 50. Outer drive shaft 40 and inner drive shaft 50 rotate about a common axis of rotation. Any suitable bearings or the like are located between the inner drive shaft 50 and the outer drive shaft 40 to allow rotation of one shaft relative to the other. Similarly, the dual drive shaft 35 is mounted for rotation via any suitable mounting having any suitable bearings on the outside of the outer drive shaft 40. The infeed roller 30 is suitably mounted on inner drive shaft 50. The outer drive shaft 40 is mechanically connected to drive the PIC roller 20 via any suitable gear train, belt/pulley arrangement or the like.

The dual drive shaft 35 of the present invention is rotated via a drive system 55 comprising an electro-mechanical clutch 60, a drive motor 70 and a drive belt 75. The drive motor 70 drives the inner drive shaft 50 via pulleys and belt 75, or any suitable connection as is known in the art. A first portion 62 of electro-mechanical clutch 60 is suitably mounted on inner drive shaft 50. A second portion 64 of electro-mechanical clutch 60 is suitably mounted on outer drive shaft 40. Accordingly, when the electro-mechanical clutch 60 is energized, the first portion 62 and the second portion 64 are coupled, and both the inner drive shaft 50 (and in feed roller 30) and the outer drive shaft 40 (and PIC roller 20) are driven. When the electro-mechanical clutch 60 is de-energized, the first portion 62 and the second portion 64 are uncoupled, and only the inner draft shaft 50 (and feed roller 30) are driven. A spur gear is used to transfer the drive.

A sensor 80, operatively connected to the electro-mechanical clutch 60, is used to control operation of the clutch. When the sensor goes "high" by the recognition of a document, the electro-mechanical clutch 60 is de-energized, and the clutch is uncoupled. As such, the outer drive shaft 40 and PIC roller 20 cease rotation. However, the inner draft shaft 50 and infeed roller 30 continue to be driven by the drive motor 70.

Figure 2:
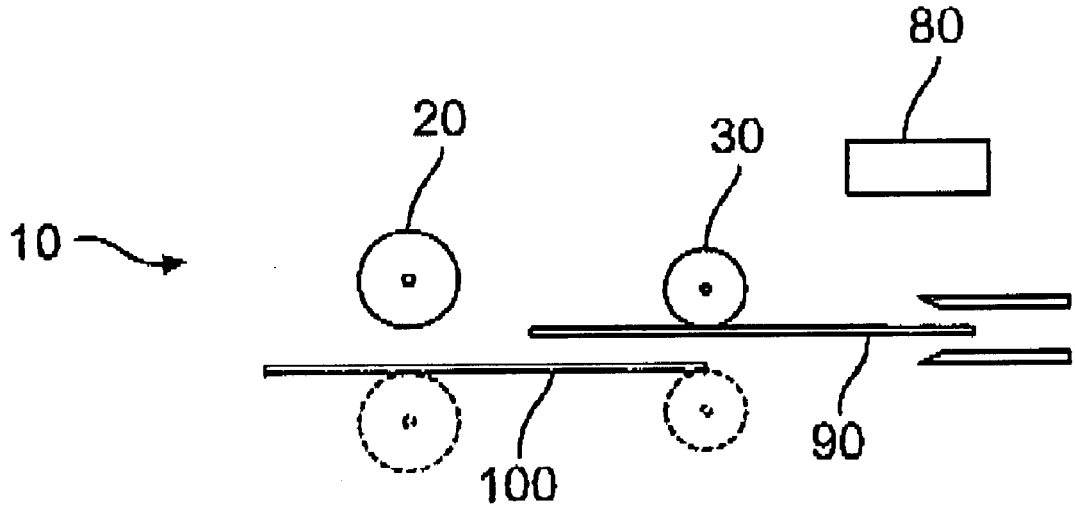
FIG. 2 is a schematic side view of the present invention.

FIG. 2 illustrates the present invention 10 in use. A stack of sheets are positioned proximate the PIC roller 20. When it is desired to feed one or more sheets from the stack of sheets, the drive motor 70 is started, and inner drive shaft 50 and infeed roller 30 are rotated. Initially, electro-mechanical clutch 60 is energized. Thus, as described above, the outer drive shaft 40 and PIC roller 20 are also rotated, as the first portion 62 and second portion 64 of the electro-mechanical clutch 60 are coupled.

As the PIC roller 20 rotates, it propels the first sheet 90 towards infeed roller 30. When sheet 90 reaches the infeed roller 30, infeed roller 30 continues to propel sheet 30 into the imaging equipment. A sensor 80 is suitably located a short distance downstream of infeed roller 30. When the leading edge of sheet 90 reaches sensor 80 and is sensed thereby, the sensor 80 sends a signal to the electro-mechanical clutch 60 to de-energize, thus disengaging first portion 62 from second portion 64 to stop rotation of outer drive shaft 40 and PIC roller 20. Inner drive shaft 50 and infeed roller 30 continue to rotate. After infeed roller 30 completes the feeding of first sheet 90, the electro-mechanical motor 60 is re-energized to once again start rotation of PIC roller 20 to feed the next sheet.

As can be seen, in the instance where the first sheet 90 is short, when the trailing edge of first sheet 90 clears PIC roller 20, the PIC roller 20 contacts a second sheet 100 and begins to propel the same towards infeed roller 30. However, sensor 80 is located sufficiently close enough to infeed roller 30 such that the electro-magnetic clutch 60 disengages and stops the PIC roller 20 before the second sheet 100 can be fed too far before the infeed roller 30 is ready to engage it.

In this manner, the feeder apparatus of the present invention can prevent jabs, misfeeds, etc., especially in the case of short sheets. Where the first sheet 90 is long, such that the PIC roller 20 becomes disengaged before the trailing edge of the first sheet 90 has cleared the PIC roller 20, the disengaged PIC roller 20 is freely rotatable to allow the sheet to be pulled from thereunder by the infeed roller 30. Accordingly, the present invention is advantageous in feeding a stack of sheets of different length, as well as short sheets.

It should be understood that the embodiments herein described are merely illustrative of the principles of the present invention. Various modifications may be made by those skilled in the art without departing from the spirit or scope of the claims which follow. Other modifications or substitutions with equivalent elements are also contemplated.

What is claimed is:

1. A sheet feeder apparatus, comprising:

a PIC roller for advancing a document from a stack;

an infeed roller for feeding said document; and a drive system for driving said PIC roller and said infeed roller, said drive system comprising a dual drive shaft having an inner drive shaft and an outer drive shaft, wherein said drive system is adapted to selectively drive said infeed roller independent of said PIC roller.

2. The apparatus of claim 1, wherein drive system comprises a clutch for selectively disengaging drive to said PIC roller.

3. The apparatus of claim 2, wherein said clutch is operable responsive to a sensor which senses said document.

4. The apparatus of claim 1, wherein a single motor drives said inner shaft and said outer shaft.

5. The apparatus of claim 1, wherein one of said inner shaft and said outer shaft drives said infeed roller and the other of said inner shaft and said outer shaft drives said PIC roller.

6. The apparatus of claim 5, wherein said drive system further comprises a clutch for selectively disengaging the shaft which drives said PIC roller.

7. The apparatus of claim 6, wherein said clutch is operable responsive to a sensor which senses said document.

8. An apparatus for feeding documents from a stack of documents, each of said documents having a leading edge, said apparatus comprising:

a PIC roller;

an infeed roller downstream of said PIC roller; and a sensor downstream of said infeed roller for sensing said documents;

said PIC roller and said infeed roller adapted to be driven together via a drive system comprising a dual drive shaft having an inner drive shaft and an outer drive shaft, wherein said PIC roller advances a first document towards said infeed roller and said infeed roller advances said first document past said sensor;

wherein when the leading edge of said first document reaches said sensor, drive to said PIC roller is temporarily halted to prevent said PIC roller from advancing a second document.

9. A method for feeding documents from a stack of documents, each of said documents having a leading edge, said method comprising the steps of:

aligning a PIC roller, an infeed roller downstream of said PIC roller, and a sensor downstream of said infeed roller;

driving said PIC roller and said infeed roller together;

advancing a first document from said PIC roller to said infeed roller;

advancing said first document from said infeed roller past said sensor;

sensing said first document via said sensor; and temporarily disengaging drive to said PIC roller while said first document is being sensed to prevent said PIC roller from advancing a second document; and re-engaging drive to said PIC roller after a predetermined amount of time to advance said second document.

10. The method of claim 9, further comprising the step of repeating the steps of claim 9 to feed said stack of documents.

11. A sheet feeder apparatus for feeding documents to a document transport path of a device, comprising:

a PIC roller for advancing a document from a stack;

an infeed roller proximate the PIC roller for feeding the document into the document transport path; and a drive system for driving the PIC roller and the infeed roller, the drive system includes a clutch for disengaging drive to the PIC roller while maintaining drive to the infeed roller, wherein the drive system is adapted to selectively drive the infeed roller independent of the PIC roller.

12. An apparatus for feeding documents from a stack of documents into a document transport path of a device, each of the documents having a leading edge, the apparatus comprising:

a PIC roller;

an infeed roller connected to the PIC roller via gearing; and a sensor downstream of the infeed roller for sensing a document;

the PIC roller and the infeed roller being adapted to be driven together wherein the PIC roller advances a first document towards the infeed roller and the infeed roller advances the first document past the sensor;

wherein when the leading edge of the first document reaches the sensor, drive to the PIC roller is temporarily halted to prevent the PIC roller from advancing a second document, and drive to the infeed roller continues.

13. A method for feeding documents from a stack of documents into a document transport path of a device, each of the documents having a leading edge, the method comprising the steps of:

driving a PIC roller and an infeed roller together, said PIC roller and said infeed roller being connected via gearing;

advancing a first document from the PIC roller to the infeed roller;

advancing the first document from the infeed roller past a sensor;

sensing the first document via the sensor; and temporarily disengaging drive to only said PIC roller when the first document is sensed to prevent the PIC roller from advancing a second document.

* * * * *